US005232116A

United States Patent [19]

Baxter

[11] Patent Number: 5,232,116

[45] Date of Patent: Aug. 3, 1993

[54] CAN CLIP

[75] Inventor: Carlton W. Baxter, Waite Hill, Ohio

[73] Assignee: Tom Thumb Clip Co., Inc., Eastlake, Ohio

[21] Appl. No.: 929,787

[22] Filed: Aug. 13, 1992

[51] Int. Cl.[5] ..... B65D 45/16

[52] U.S. Cl. ..... 220/324; 220/326; 220/355; 292/258; 292/288; 24/563

[58] Field of Search ..... 220/324, 326, 319, 355, 220/759; 292/258, 288; 215/293, 280; 24/563, 546

[56] References Cited

U.S. PATENT DOCUMENTS

| | | | |
|---|---|---|---|
| 247,547 | 9/1881 | Eiseman | 292/258 |
| 2,074,475 | 3/1937 | Jesser | 292/258 |
| 2,665,936 | 1/1954 | Moore | 220/759 X |
| 2,695,806 | 11/1954 | Balint | 292/258 |
| 2,743,128 | 4/1956 | Hawkswell et al. | 220/324 X |
| 2,762,061 | 9/1956 | Ball | 292/258 |
| 3,035,860 | 5/1962 | Bradner | 220/324 X |
| 3,612,335 | 10/1971 | Schurman | 220/324 X |
| 3,823,967 | 7/1974 | Knize | 292/258 |
| 3,868,041 | 2/1975 | Knize | 220/324 |
| 4,333,599 | 6/1982 | Stemen | 292/258 X |
| 4,605,978 | 8/1986 | Zeavin | 24/563 X |
| 4,634,429 | 1/1987 | Schoettleg | 24/563 X |
| 4,744,486 | 5/1988 | Godinho | 220/319 |

*Primary Examiner*—Allan N. Shoap
*Assistant Examiner*—Paul A. Schwarz
*Attorney, Agent, or Firm*—Renner, Otto, Boisselle & Sklar

[57] ABSTRACT

A can clip comprises a generally C-shape spring metal clip body having a central bight portion and upper and lower arms extending from said central bight portion and defining between outer ends thereof an opening for passage therebetween of the peripheral edge portion of a lid and annular bead of a container. The central bight portion has a J-shape formed by an upright stem and a rounded base forming the lower end of the clip body. The lower arm slopes upwardly and outwardly and away from the rounded base and has an outer end portion intended to engage the underside of the container bead adjacent the side wall of the container. The upper arm extends from the upper end of the stem and has a horizontally disposed outer end portion having a concave bottom surface for engaging the top of the peripheral edge portion of the lid when urged thereover while the outer end portion of the lower arm moves to engagement beneath the container bead, whereby the peripheral edge portion of the lid and container bead will be embraced and clamped together by the clip body. Also disclosed is another type of can clip that extends from the lid to the bottom of the container for securing the lid to the container, this clip comprising a spring metal clip body having a lower hook portion and an upper catch portion interconnected by an elongate straight shank portion.

15 Claims, 2 Drawing Sheets

CAN CLIP

The invention herein described relates generally to can clips used to retain a lid on a can and, more particularly, to can clips useful with containers and lids of the type described in U.S. Pat. No. 4,880,131.

BACKGROUND

Conventional metal containers, particularly paint containers and the like for use by the consuming public which are cylindrical in shape, typically comprise a lid which fits into an annular grooved ring member surrounding the open end of the container. Although the ring member and lid are sized and configured to provide an interference fit that holds the lid in place, can clips have been used to hold more securely the lid to the container as may be required for transport in airplanes.

U.S. Pat. No. 4,880,131 describes a new type of container and lid wherein the upper end of the container's sidewall is curled into a circular bead for sealingly engaging in an annular sealing groove formed by an inverted U-shape peripheral edge portion of the lid. Such type of container is particularly advantageous in that it eliminates the ring member and the drawbacks associated therewith, as set forth in said patent. However, the prior art can clips previously used with the prior containers and lids are not usable with this new type of container and lid.

SUMMARY OF THE INVENTION

The present invention provides a can clip that can be used with the aforesaid new type of container and lid to provide for more secure retention of the lid on the container than that afforded by the interference fit between the lid and annular bead at the top of the container. To this end, a can clip according to the invention comprises a generally C-shape spring metal clip body having a central bight portion and upper and lower arms extending from said central bight portion and defining between outer ends thereof an opening for passage therebetween of the groove forming peripheral edge portion of the lid and the annular bead of the container. The central bight portion has a J-shape formed by an upright stem and a rounded base forming the lower end of the clip body. The lower arm slopes upwardly and outwardly away from the rounded base and has an outer end portion for engaging the underside of the container bead adjacent the side wall of the container. The upper arm extends from the upper end of the stem and has a horizontally disposed outer end portion having a concave bottom surface for engaging the top of the peripheral edge portion of the lid when slid thereover while the outer end portion of the lower arm moves to engagement beneath the container bead, whereby the peripheral edge portion of the lid and container bead will be embraced and clamped together by the clip body.

According to a preferred embodiment of the invention, the upper arm terminates at an upwardly turned edge portion intended to cammingly engage the top of the inverted U-shape peripheral edge portion of the lid to flex open the clip body as the upper arm is passed over the peripheral edge portion to bring the concave bottom surface thereof into engagement with the top of the peripheral edge portion. Also, the lower arm has an inner straight portion and an outer end portion that is angled preferably outwardly with respect to the inner straight portion to catch under a peripheral edge bead of the lid during installation of the clip.

Further in accordance with a preferred embodiment of the invention, the upper arm has an inner portion extending from the central bight portion to the horizontally disposed outer end portion of the upper arm, and the inner portion of the upper arm is substantially parallel to the inner portion of the lower arm.

The invention also provides a container in combination with a lid and a clip for securing the lid to the container, the lid having an annular inverted U-shape peripheral edge portion defining a downwardly opening sealing groove; the container having an annular side wall portion terminating at its upper end at a radially outwardly disposed annular bead configured for sealingly engaging in the sealing groove of the lid; and the clip comprising a spring metal clip body having upper and lower arms interconnected by a central bight portion, the lower arm sloping upwardly and away from the lower end of the central bight portion and having an outer end portion engaging the underside of the container bead adjacent the annular side wall of the container, and the upper arm extending from the upper end of the central bight portion and having an outer end portion having a concave bottom surface engaging the top of the peripheral edge portion of the lid, whereby the peripheral edge portion of the lid and container bead are embraced and clamped together by the clip body. Preferably multiple clips are circumferentially spaced around the can.

According to another aspect of the invention, there is provided a can clip that extends from the lid to the bottom of the container for securing the lid to the container, the container having a bottom edge seam surrounding a recessed bottom wall of the container. The can clip comprises a spring metal clip body having a lower hook portion and an upper catch portion interconnected by an elongate straight shank portion. The lower hook portion extends to one side of the shank portion and is adapted to hook underneath the bottom edge seam. The upper catch portion extends to the same side of the shank portion as the hook portion and has an inverted U-shape portion adjacent the shank terminating at an upwardly turned end portion. The inverted U-shape portion is adapted to latch over the inverted U-shape peripheral edge portion of the lid preferably with a closely conforming fit, and the upwardly turned end portion is operative to cammingly engage the top of the inverted U-shape peripheral edge portion of the lid to flex open the clip body as the catch portion is urged over the peripheral edge portion of the lid with the lower hook portion caught beneath the bottom edge seam of the container, whereby the lid and container will be embraced between the catch and hook portions. The invention further provides the aforesaid clip in combination with the container and lid, the clip functioning to hold the lid to the container. Preferably multiple clips are circumferentially spaced around the can.

The foregoing and other features of the invention are hereinafter fully described and particularly pointed out in the claims, the following description and the annexed drawings setting forth in detail certain illustrative embodiments of the invention, these being indicative, however, of but a few of the various ways in which the principles of the invention may be employed.

DETAILED DESCRIPTION

In this specification, references to vertical and horizontal, top and bottom, upper and lower, inwardly and outwardly, etc., are used for convenience in description and not by way of limiting the can clip to a specific orientation inasmuch as the spacial orientation of the can clip and combinations thereof with containers and lids will be dependent on the particular application made of the can clip and/or the orientation of the container and lid associated therewith.

Figure 1:
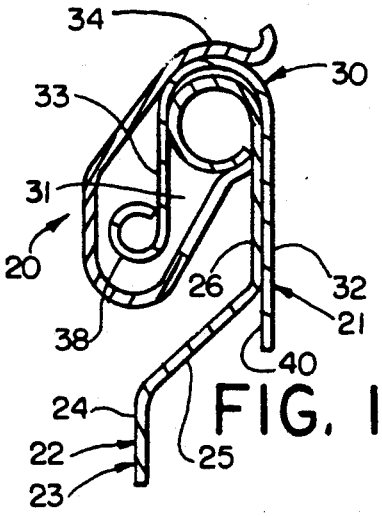
FIG. 1 is a sectional view of a can clip according to the invention as used to secure a lid to a container.

Referring now in detail to the drawings and initially to FIG. 1, a can clip according to the invention, indicated generally by reference numeral 20, is shown as used to secure a lid 21 to a container 22 of the type described and shown in U.S. Pat. No. 4,880,131, which patent is hereby incorporated herein by reference for its showing and description of further details of the container and lid. However, it can be seen in FIG. 1 that the side wall 23 of the container has a lower generally cylindrical portion 24, an intermediate frusto-conical portion 25 and an upper generally cylindrical portion 26. At the top of the container the side wall is curled to form an annular, radially outwardly protruding rim or bead 27 which surrounds the open top of the container that is closed by the lid.

The lid 21 has a generally circular configuration with an annular inverted U-shape peripheral edge portion 30 defining a downwardly opening sealing groove 31 adapted to receive and sealingly engage the container bead 27. The sealing groove 31 is more particularly defined by an axially extending inner sealing wall 32 and an axially extending outer sealing wall 33 which are interconnected by a curved bight wall 34. The lower edge of the outer sealing wall 33 is curled to form a bead 38 which may function as a pry point for removing the lid from the container.

When the lid 21 is applied to the container 22, an interference fit is formed between the inner sealing wall 32 and the inner sealing surface 40 of the sidewall portion 26 over a rather large, air tight sealing area. Also, a relatively small area, almost line contact, is established between the outer sealing wall 33 and the container bead 27. As may be desired, a sealant can be applied between the top of the container bead and the bight wall 34 of the lid to ensure an air-tight seal.

Although the lid 21 and container 22 are configured to provide an interference fit that holds the lid in place, some situations may requrie the lid to be held more securely to the container, such as for transport in turcks, airplanes, etc. This is accomplished by the can clip 20 which may be installed as shown. The container or lid may be configured as shown in FIG. 1 around the entire periphery thereof, in which case the can clip 20 may be installed anywhere around the periphery of the container and lid. That is, sufficient space exists between the lid rim 38 and the frusto-conical portion 25 of the side wall 23 to permit installation of the clip on the lid and container in the hereinafter described manner. In other instances, adequate space for installation may only exist at pry recesses circumferentially spaced around the lid, in which case a clip or clips may be installed at one or more of the pry recesses. Typically, several can clips will be circumferentially spaced around the periphery of the lid.

Figure 2:
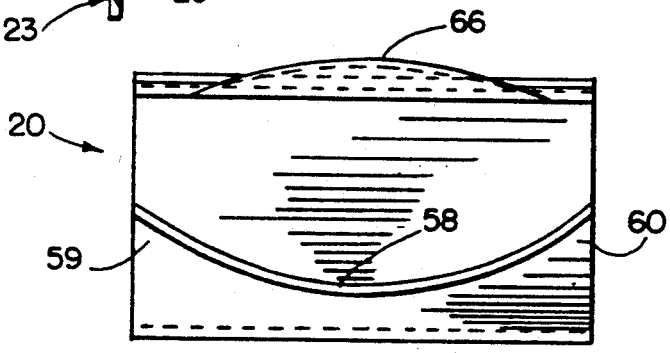
FIG. 2 is a front elevational view of the can clip of FIG. 1.
Figure 3:
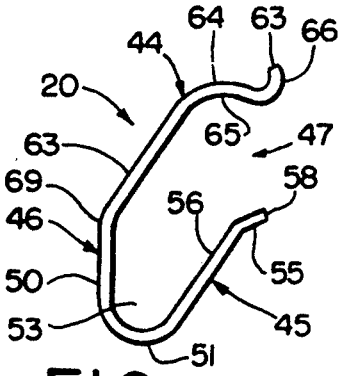
FIG. 3 is an end elevational view of the can clip of FIG. 1.

Referring additionally to FIGS. 2 and 3, the can clip 20 comprises a spring metal clip body which may me made of any suitable material affording desired strength characteristics such as spring steel. The clip preferably is of uniform width and has upper and lower arms 44 and 45 interconnected by a central bight portion 46. The upper and lower arms of the clip define between outer ends thereof an opening 47 for passage therebetween of the peripheral edge portion of the lid and annular bead of the container when the clip is installed as shown in FIG. 1.

The central bight portion 46 of the clip body has a J-shape formed by an upright straight vertical stem 50 and a rounded base 51 forming the lower end of the clip body. The lower arm 45 slopes upwardly and away from the base 51 and preferably to a point about midway the overall height of the clip when the clip is in its unsprung condition shown in FIGS. 2 and 3, whereby the opening 47 is upwardly shifted with respect to upper and lower ends of the clip as seen in FIG. 3. This creates a trough or hollow 53 in the lower half of the clip for accommodating the lid bead 38 (FIG. 1). When the clip is in its unsprung condition, the height of the opening 47 is less than the corresponding height of the mated container bead 27 and peripheral edge portion 30 of the lid 21 whereby the clip will apply a clamping force for securely holding the lid to the container at the location of the clip.

The lower arm 45 terminates at an outer end portion 55 intended to engage the underside of the container bead 27 adjacent the vertically extending annular wall 26 of the container 22 as illustrated in FIG. 1. Preferably, and with some can configurations importantly, the outer end portion is angled preferably outwardly relative to a straight inner portion 56 of the lower arm, this facilitating and/or enabling insertion of the outer end of the lower arm into the space between the lid bead 38 and the frusto-conical wall portion 25 of the can 22 during installation of the clip. In the illustrated embodiment, the inner portion 56 and outer end portion 55 respectively form with the stem 50 included angles of about 35° and about 60°, although it is contemplated that such angles may vary to some extent such as within plus or minus 10°. Also, the inner portion 56 is considerably longer than the outer end portion 55 preferably by at least a factor of three.

As is preferred, the outer edge 58 of the lower arm 45 is concave as seen in FIG. 2 so as to form laterally spaced apart tines or projections 59 and 60 for engaging beneath the container bead 27. The depth of the concavity may be such that it extends approximately one half the length of the lower arm 45. Although the outer edge 58 preferably is arcuately concave as shown, the concave outer edge may be otherwise configured while still forming the laterally spaced apart tines 59 and 60. Also, the tines may be pointed as shown as is preferred, or they may be truncated or otherwise configured as may be desired in some applications. A tine with a truncated or flattened end may be desirable when there is concern about possible puncturing of the can wall as when the can wall is made of very thin gauge metal. In the clip 20, only the ends of the tines are bent to form the outer end portion of the lower arm that engages the container bead.

The upper arm 44 has an inner portion 63 that extends upwardly and outwardly away from the upper end of the base 50 to a horizontally disposed outer end portion 64. The upper end portion 64 has a relatively low profile so as to permit stacking of one container atop another notwithstanding the presence of the can clips. The outer end portion 64 has a concave bottom surface 65 for engaging the top of the inverted U-shape peripheral edge portion 30 of the lid 21 when urged over the top thereof with the outer end portion of the lower arm moving to engagement beneath the container bead 27, whereby the peripheral edge portion of the lid and container bead will be embraced and clamped together by the clip. Preferably the bottom surface 65 is arcuately concave as shown, with a radius corresponding to the radius of the bight wall 34 of the lid 21.

The upper arm 44 terminates at an upwardly curled or turned edge portion 66 intended to cammingly engage the top of the inverted U-shape peripheral edge portion 30 of the lid 21 to flex open the clip as the upper portion is urged thereover. As seen in FIG. 2, the upturned edge portion 66 does not extend the full width of the clip in that the outer edge 68 of the upper arm is convex. Preferably the outer edge of the upper arm is arcuately convex and has a radius corresponding to the radius of the concave outer edge 58 of the lower arm 45. The upturned edge portion 66 is disposed almost directly above and preferably horizontally offset slightly outwardly with respect to the outer ends of the lower arm tines 59 and 60.

The inner portion 63 of the upper arm 44 preferably is substantially parallel to the inner portion 56 of the lower arm 45. The inner portion 63 joins the stem at a bend 69 which is relatively sharp (smaller radius) when compared to the arcuate outer portion 64 of the upper arm 44 or the curved base 51. This relatively sharp bend preferably is located at about the same elevation as the outer end of the lower arm. Consequently, the inner portion 63 has a length greater the height of the stem 50.

As will be appreciated, the gradually curved base 51 of the J-shape bight portion 46 functions as a hinge during flexed opening of the clip as it is pushed onto the juxtaposed peripheral edges of the lid and container.

Installation of the clip 20 is effected by first positioning the clip such that the outer end of the lower arm 45 is caught underneath the lid bead 38 with the upturned outer edge portion 66 of the upper arm 44 resting against the outer sealing wall of the peripheral edge portion 30 of the lid 21. The clip is then forced upwardly such as by using one's thumb to push upwardly on the rounded lower end 51 of the clip. As the clip is forced upwardly, the outer end of the lower arm initially slides along the lower radially inner side of the round lid bead until it moves upwardly and radially inwardly away from the lid bead and into engagement with the underside of the container bead adjacent the vertically extending wall 26 of the container 22. More particularly and as shown in FIG. 1, the outer end of the lower arm engages in a downwardly opening, generally V-shape notch formed between the underside of the container bead and the vertically extending wall 26 of the container. At the same time, the outer end of the upper arm slides along the outer sealing wall of the peripheral edge portion of the lid and over the arched bight wall 34 to an over center position with respect to the point of engagement between the outer end of the lower arm and the underside of the container bead. As this occurs the clip body is cammed open, i.e., the upper and lower arms are spread apart, to allow the juxtaposed peripheral edges of the container and lid to pass between the upper and lower arms. The fully installed, over center position of the clip serves to hold the clip in place, as will interference between the lower portion of the lower arm and the lid bead. Also, the flexed clip will apply a vertical clamping force serving to hold the lid edge to the container bead and further to lock the clip in place. Regarding removal, the clip may be pried or pulled off in reverse manner, as by pushing or pulling radially outwardly on the outer end of the upper arm portion and then downwardly to remove the clip.

Figure 12:
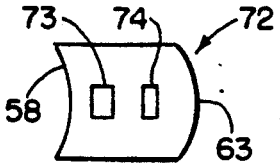
FIG. 12 is a plan view of a blank used to form the can clip according to the invention.

The clip may be formed from a flat blank of uniform thickness as by bending, such as from a blank 72 having the configuration illustrated in FIG. 12. As shown, the blank is of uniform width and has opposite concave and convex edges that correspond to the outer edges 58 and 68 of the lower and upper arms of the clip. Preferably the edges are of the same radius. One advantage of this is that the blanks may be struck from sheet material end-to-end without any waste except at the ends of the sheet. That is, the ends of the blanks preferably having matching configurations so that formation of one edge on one clip blank automatically forms the opposite edge of the next adjacent clip blank struck from the sheet. As also illustrated in FIG. 12, the clip blank may have one or more openings formed therein as may be desirable to facilitate easier installation of the clip by reducing the force necessary to flex open the clip. For example, an opening 73 may be located for positioning in the lower rounded hinge region of the clip. Also, an opening 74 may be disposed in the upper arm region of the clip wherein a tool may be inserted to aid in the installation and/or removal of the clip.

Figure 15:
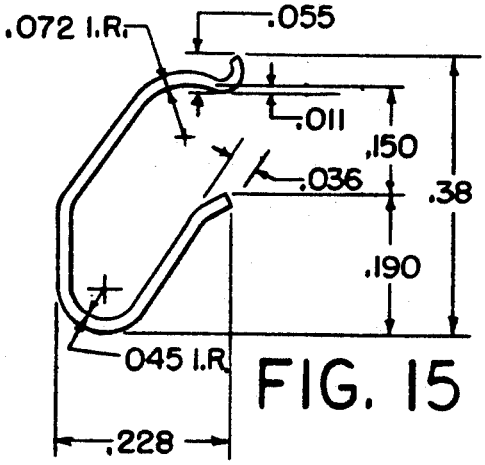
FIGS. 15 and 16 are views similar to FIGS. 3 and 2, respectively, wherein exemplary dimensions are indicated.
Figure 16:
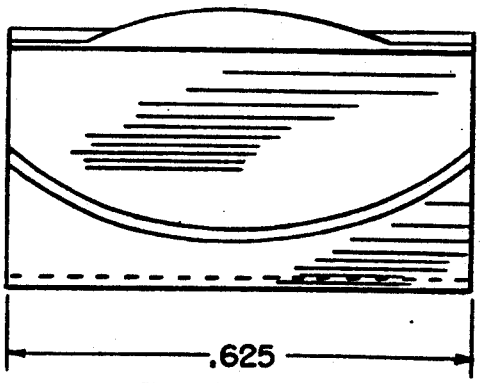

Referring now to FIGS. 15 and 16, there are indicated exemplary dimensions of the can clip shown in FIGS. 1-3, which dimensions are given for a can clip to be used with a one gallon cylindrical container. The can clip of such dimensions may be formed from 0.017 inch thick spring steel. It is believed that the dimensions may be downsized or upsized for smaller or larger containers while retaining the relationships between the specified dimensions. However, some variation of the dimensional relationships likely will be necessary to compensate, for example, for changes in the differences in size and configuration of containers and lids of the aforedescribed type.

Figure 4:
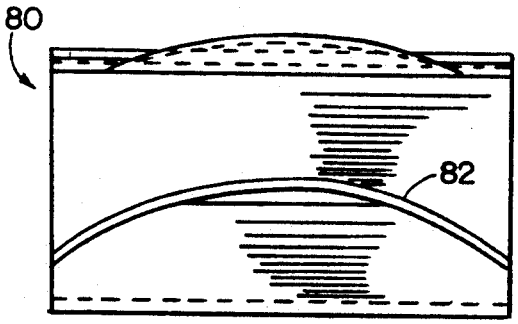
FIG. 4 is a front elevational view of another embodiment of can clip according to the invention.
Figure 5:
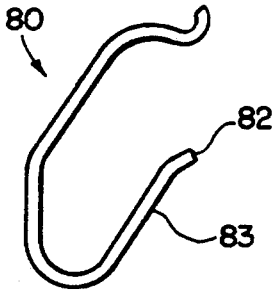
FIG. 5 is an end elevational view of the can clip of FIG. 4.

Turning now to FIGS. 4 and 5, another can clip according to the invention is designated generally by reference numeral 80. The can clip 80 is identical to the can clip 20 of FIGS. 1–3, except that the outer edge 82 of the lower arm 83 is convex instead of concave. Accordingly, only the center portion of the outer edge of the lower arm will engage the underside of the container bead. Moreover, the edge is rounded with a large radius to minimize the possibility of puncturing the container wall adjacent the bead, as could be a concern when the container is made of relatively thin gauge sheet metal.

Figure 6:
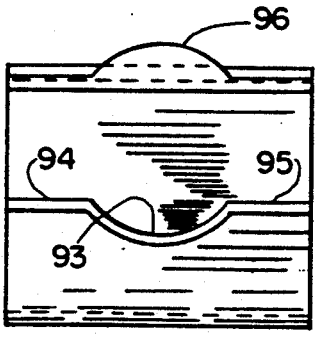
FIG. 6 is a front elevational view of a further embodiment of can clip according to the invention.
Figure 7:
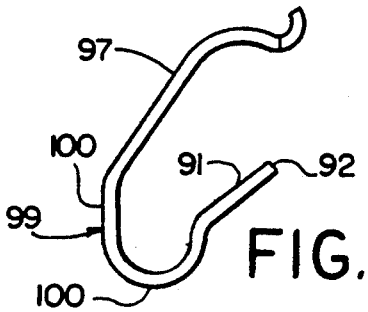
FIG. 7 is an end elevational view of the can clip of FIG. 6.

In FIGS. 6 and 7, another can clip according to the invention is designated generally by reference numeral 90. The can clip 90 is identical to the can clip 20 of FIGS. 1–3 except for the following differences. One difference is that the outer edge 92 has a central concave surface 93 disposed between horizontal straight surfaces 94 and 95. This configuration provides for two projections having flat ends disposed on opposite sides of a recessed area which accommodates the curvature of the container. The outer edge 96 of the upper arm 97 is correspondingly configured except that the central portion is convex instead of concave, thereby providing a centrally located camming surface between the laterally spaced apart, flattened projections at the outer end of the lower arm 91.

Another difference is in the configuration of the central bight portion 99. The base 100 of the bight portion 99 extends through a greater arc than the base 51 of the clip 20 and almost through a full 180°. Consequently, the lower arm 91 is relatively shorter. As also seen in FIG. 7, the lower arm is not provided with an outer bent end portion. A further difference is that the upright stem 101 is shorter when compared to the upper arm 97.

Figure 8:
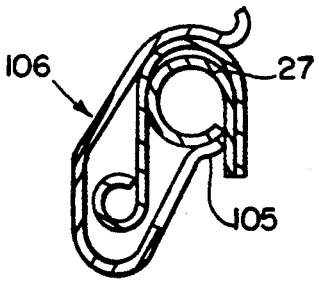
FIGS. 8–11 are sectional views of still other embodiments of can clips according to the invention as used to secure lids to containers.
Figure 9:
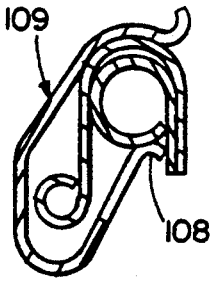
Figure 10:
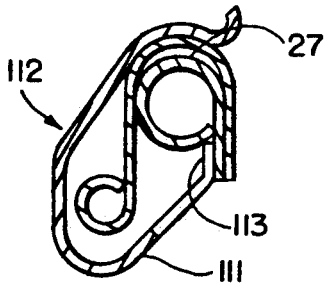
Figure 11:
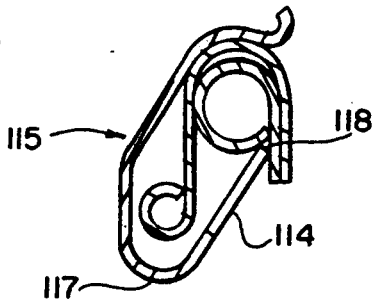

Turning now to FIGS. 8–11, several can clips are illustrated which for the most part are identical to the can clip 20 of FIGS. 1–3 except for the manner in which the outer end portion of the lower arm is configured. In FIG. 8, the angled outer end portion 105 of can clip 106 is concave thereby to better conform to the curved bottom surface of the container bead 27. In FIG. 9, the angled outer end portion 108 of can clip 109 is oppositely turned to present a convex surface to the container bead 27. In FIG. 10, the lower arm 111 of can clip 112 has an outer end portion 113 which is bent inwardly to an upright orientation, as opposed to the outwardly bent end portion 55 of the clip 20. In FIG. 11, the outer end portion of the lower arm 114 of the clip 115 that engages the container bead 27 is in line with the inner portion of the lower arm, i.e., the lower arm is straight along its entire length extending from the base 117 to its outer edge 118.

Figure 13:
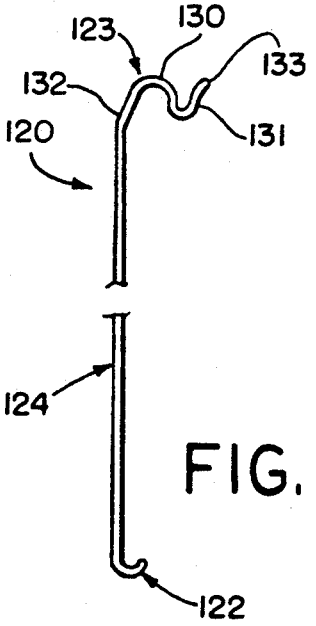
FIG. 13 is an end elevational view of a different type of can clip according to the invention.
Figure 14:
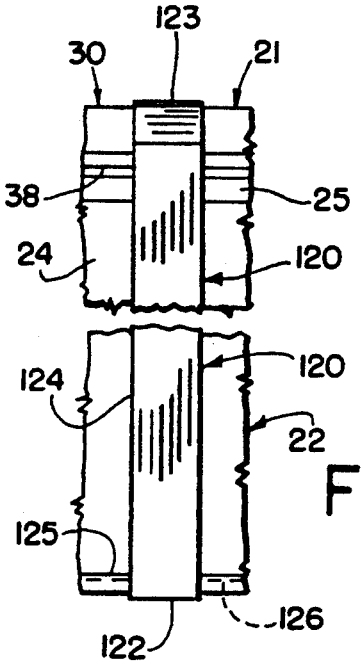
FIG. 14 is a front elevational view of the can clip of FIG. 13 as used to secure a lid to a container.

Referring now to FIGS. 13 and 14, another type of can clip according to the invention is indicated generally at 120. The can clip comprises a spring metal clip body having a lower hook portion 122 and an upper catch portion 123 interconnected by an elongate straight shank portion 124. The lower hook portion extends to one side of the shank portion and is adapted to hook underneath the bottom edge seam 125 of the container 22 which has a recessed bottom 126 to provide space for accommodating the upturned end of the hook portion. The upper catch portion 123 extends to the same side of the shank portion 124 as the hook portion and has an inverted U-shape portion 130 adjacent the shank. The U-shape portion terminates at an upwardly turned end portion 131.

The inverted U-shape portion 130 is adapted to fit over the inverted U-shaped peripheral edge portion 30 of the lid 21. More particularly, the inverted U-shape portion forms a downwardly opening groove for receiving the peripheral edge portion 30 of the lid, the groove having a radius about equal the radius of the bight wall of the lid edge portion 30. Preferably the upper catch portion 123 joins the upper end of the shank at a shallow bend 132 which properly positions the groove in the catch portion radially inwardly with respect to the cylindrical side wall portion 24 of the container against which the shank runs vertically from the bottom to the top of the container.

The upwardly turned end portion 131 is operative to cammingly engage the top of the inverted U-shape peripheral edge portion 30 of the lid 21 to flex open the clip to allow the catch portion to pass over the top of the peripheral edge portion of the lid with the lower hook portion 122 caught beneath the bottom edge seam 125 of the container, whereby the lid and container will be embraced between the catch and hook portions. Preferably, the upwardly turned end portion extends upwardly a sufficient distance, such to about the same height as the inverted U-shape portion 130, to form a tab 133 that facilitates installation and removal of the clip. During installation, an installer may position a finger or fingers against the side of the shank opposite the catch and then engage the tab 133 with his/her thumb to rotate the catch counter-clockwise in FIG. 13 to open the clip for more easy passage of the catch over the top of the peripheral edge portion of the lid. In similar manner, the upper catch portion may be rotated counterclockwise to effect removal of the clip.

Although the clip 120 is primarily intended to be used with containers and lids of the type shown, such clip may be useful with other types of container and lid assemblies having a bottom edge seam or the equivalent and a lid with a peripheral edge portion over which the upper catch portion may be rotated to an over-center or radial interference position.

Although the invention has been shown and described with respect to various embodiments thereof, it is obvious that equivalent alterations and modifications will occur to others skilled in the art upon the reading and understanding of the specification. The present invention includes all such equivalent alteration and modification, and is limited only by the scope of the following claims.

What is claimed is:

1. A can clip for securing a lid to a container, the lid having an annular inverted U-shape peripheral edge portion defining a downwardly opening sealing groove and the container having an annular side wall portion terminating at its upper end at a radially outwardly disposed annular bead configured for sealingly engaging in the sealing groove of the lid, said can clip comprising a generally C-shape spring metal clip body having a central bight portion and upper and lower arms extending from said central bight portion and defining therebetween an opening for passage therebetween of the peripheral edge portion of the lid and annular bead of the container, said central bight portion having a J-shape formed by an upright straight stem and a rounded base forming a lower end of said clip body, said lower arm sloping upwardly and away from the rounded base and having an outer end portion for engaging the underside of the container bead adjacent the side wall of the container, and said upper arm extending from an upper end of said stem and having a horizontally disposed outer end portion having a concave bottom surface for engaging the top of the peripheral edge portion of the lid when urged thereover while the outer end portion of the lower arm moves to engagement beneath the container bead, whereby the peripheral edge portion of the lid and container bead will be embraced and clamped together by said clip body, said upper arm terminating at an upwardly turned edge portion intended to cammingly engage the top of the inverted U-shape peripheral edge portion of the lid to flex open said clip body as said upper arm is urged over the peripheral edge portion of the lid to bring the concave bottom surface thereof into engagement with the top of the peripheral edge portion, and said upper arm having an inner straight portion extending upwardly and slanting away from said stem to said horizontally disposed outer end portion of said upper arm.

2. A can clip as set forth in claim 1, wherein said lower arm has a straight inner portion and said outer end portion of said lower arm is angled with respect to said straight inner portion of said lower arm.

3. A can clip as set forth in claim 2, wherein said outer end portion of said lower arm is turned outwardly with respect to said straight inner portion of said lower arm.

4. A can clip as set forth in claim 3, wherein said clip body has a vertical axis, said straight inner portion of said lower arm forms with a vertical axis of said clip body an included angle in the range of 30° to 45°, and said outer end portion of said lower arm is linear and forms with the vertical axis an included angle in the range of 50° to 70°.

5. A can clip as set forth in claim 2, wherein said outer end portion of said lower arm is disposed horizontally outwardly of a vertical line bisecting said concave bottom surface of said upper arm.

6. A can clip as set forth in claim 1, wherein said inner straight portion of said upper arm is substantially parallel to said lower arm.

7. A can clip as set forth in claim 4, wherein the upper end of said stem and outer end of said lower arm are at about the same elevation.

8. A can clip as set forth in claim 1, wherein said lower arm has an outer edge at least a portion of which is concave.

9. A can clip as set forth in claim 1, wherein said lower arm of said clip body has a convex outer edge.

10. A can clip as set forth in claim 1, wherein said outer end portion of said lower arm has a central recessed portion disposed between laterally spaced apart prongs operative to engage the can at laterally spaced apart locations.

11. A container in combination with a lid and a clip for securing said lid to said container, said lid having an annular inverted U-shape peripheral edge portion defining a downwardly opening sealing groove, said container having an annular side wall portion terminating at an upper end at a radially outwardly disposed annular bead configured for sealingly engaging in the sealing groove of said lid, said bead having an underside forming with said sidewall portion a downwardly opening, generally V-shape notch, and said clip comprising a spring metal clip body having upper and lower arms interconnected by a central bight portion, said central bight portion having upper and lower ends, said lower arm sloping upwardly and away from the lower end of said central bight portion towards said notch and having an outer end portion engaging in said generally V-shape notch formed by the underside of said container bead and said annular side wall of said container, and said upper arm extending from the upper end of said central bight portion and having a horizontally disposed outer end portion having a concave bottom surface engaging the top of said peripheral edge portion of said lid, whereby the peripheral edge portion of the lid and container bead will be embraced and clamped together by said clip body.

12. A can clip for securing a lid to a container, the lid having an annular inverted U-shape peripheral edge portion defining a downwardly opening sealing groove, and the container having, at an upper end, a vertically extending annular wall portion terminating at a radially outwardly disposed annular bead configured for sealingly engaging in the sealing groove of the lid and, at a bottom end, a bottom edge seam surrounding a recessed bottom wall of the container, said can clip comprising a spring metal clip body having a lower hook portion and an upper catch portion interconnected by an elongate straight shank portion, said lower hook portion extending to one side of said shank portion and being adapted to hook underneath the bottom edge seam, said upper catch portion extending to the same side of said shank portion as said hook portion and having an inner straight portion extending upwardly and slanting away from said shank portion to an inverted U-shape portion adjacent said shank portion terminating at an upwardly turned end portion, said inverted U-shape portion being adapted to fit over the inverted U-shape peripheral edge portion of the lid, and said upwardly turned end portion being operative to cammingly engage a top of the inverted U-shape peripheral edge portion of the lid to flex open said clip body as said catch portion is urged over the top of the peripheral edge portion of the lid with the lower hook portion caught beneath the bottom edge seam of the container, whereby the lid and container will be embraced between the catch and hook portions.

13. A can clip as set forth in claim 12, wherein said upwardly turned end portion forms a tab by which the catch portion may be finger rotated to facilitate installation or removal of the clip.

14. A container in combination with a lid and a clip for securing said lid to said container, said lid having an annular inverted U-shape peripheral edge portion defining a downwardly opening sealing groove, said container having a bottom edge seam surrounding a recessed bottom wall and an annular side wall portion terminating at an upper end at a radially outwardly disposed annular bead configured for sealingly engaging in the sealing groove of said lid, and said clip comprising a lower hook portion and an upper catch portion interconnected by an elongate straight shank portion, said lower hook portion extending to one side of said shank portion and being adapted to hook underneath said bottom edge seam, said upper catch portion extending to the same side of said shank portion as said hook portion and having an inner straight portion extending upwardly and slanting away from said shank portion to an inverted U-shape portion adjacent said shank portion terminating at an upwardly turned end portion, and said inverted U-shape portion being hooked over said inverted U-shape peripheral edge portion of said lid, whereby the lid and container will be embraced between the catch and hook portions.

15. A can clip for securing a lid to a container, the lid having an annular inverted U-shape peripheral edge portion defining a downwardly opening sealing groove and the container having an annular side wall portion terminating at an upper end at a radially outwardly disposed annular bead configured for sealingly engaging in the sealing groove of the lid, said can clip comprising a generally C-shape spring metal clip body having a central bight portion and upper and lower arms extending from said central bight portion and defining therebetween an opening for passage therebetween of the peripheral edge portion of the lid and annular bead of the container, said central bight portion having a J-shape formed by an upright stem and a rounded base forming a lower end of said clip body, said lower arm sloping upwardly and away from the rounded base and having an outer end portion for engaging the underside of the container bead adjacent the side wall of the container, and said upper arm extending from an upper end of said stem and having a horizontally disposed outer end portion having a concave bottom surface for engaging the top of the peripheral edge portion of the lid when urged thereover while the outer end portion of the lower arm moves to engagement beneath the container bead, whereby the peripheral edge portion of the lid and container bead will be embraced and clamped together by said clip body, said lower arm having an outer edge surface at least a portion of which is concave, said upper arm having an outer edge surface at least a portion of which is convex, and said outer edge surface of said upper arm and said outer edge surface of said lower arm being complementary in shape.

* * * * *